US010825617B2

(12) United States Patent
Moszynski et al.

(10) Patent No.: US 10,825,617 B2
(45) Date of Patent: Nov. 3, 2020

(54) ELECTRIC CLOSING ELEMENT

(71) Applicant: Auto-Kabel Management GmbH, Hausen i.W. (DE)

(72) Inventors: Markus Moszynski, Erkelenz (DE); Stefan Billen, Mönchengladbach (DE)

(73) Assignee: Auto-Kabel Management GmbH, Hausen i.W. (DE)

( * ) Notice: Subject to any disclaimer, the term of this patent is extended or adjusted under 35 U.S.C. 154(b) by 0 days.

(21) Appl. No.: 16/496,009

(22) PCT Filed: Jan. 23, 2018

(86) PCT No.: PCT/EP2018/051570
§ 371 (c)(1),
(2) Date: Sep. 20, 2019

(87) PCT Pub. No.: WO2018/171954
PCT Pub. Date: Sep. 27, 2018

(65) Prior Publication Data

US 2020/0286693 A1 Sep. 10, 2020

(30) Foreign Application Priority Data

Mar. 22, 2017 (DE) ..... 10 2017 106 117

(51) Int. Cl.
*H01H 1/36* (2006.01)
*H01H 39/00* (2006.01)
(Continued)

(52) U.S. Cl.
CPC ..... *H01H 1/52* (2013.01); *H01H 1/365* (2013.01); *H01H 9/02* (2013.01); *H01H 39/004* (2013.01); *H01H 2239/044* (2013.01)

(58) Field of Classification Search
CPC ..... H01H 39/00; H01H 39/004; H01H 2039/008; H02H 9/041
See application file for complete search history.

(56) References Cited

U.S. PATENT DOCUMENTS 1,321,381 A 11/1919 Loomis
6,839,209 B2 * 1/2005 Shea ..... H01H 39/004 361/2
(Continued)

FOREIGN PATENT DOCUMENTS

CN 102005336 A 4/2011
DE 27 52 638 A1 5/1979
(Continued)

OTHER PUBLICATIONS

European Patent Office, International Search Report and the Written Opinion of the International Searching Authority, Application No. PCT/EP2018/051570, dated Apr. 5, 2018 (*with English translation of the International Search Report*), 16 pages.
(Continued)

*Primary Examiner* — Vanessa Girardi
(74) *Attorney, Agent, or Firm* — Sunstein LLP

(57) ABSTRACT

An electric closer comprising a first connection lug, a second connection lug electrically insulated from the first connection lug, the first and second connection lugs each having at least one recess in a contact region disposed within a guide housing, an actuator for driving a contact element, the contact element being disposed in a guide housing between the actuator and the contact region of the connection lugs, and by the actuator from an open position, in which the connecting lugs are insulated from one another into a closed position, in which the connecting lugs are electrically connected to one another via the contact element, is displaceable, wherein in the closed position the contact element is accommodated in the recesses of the connecting lugs and wherein the contact element is guided in the displacement direction simultaneously in the respective recesses of the two connecting lugs during the displacement of the two connecting lugs.

14 Claims, 7 Drawing Sheets

(51) Int. Cl.
*H01H 1/52* (2006.01)
*H01H 9/02* (2006.01)

(56) References Cited

U.S. PATENT DOCUMENTS

| | | | | |
|---|---|---|---|---|
| 8,492,672 | B2 * | 7/2013 | Shea | H01H 39/004 218/43 |
| 8,692,149 | B2 * | 4/2014 | Gentsch | H01H 39/004 218/121 |
| 9,646,788 | B2 * | 5/2017 | Parks | H01H 39/004 |
| 10,593,496 | B2 * | 3/2020 | Numata | H02H 3/16 |
| 2003/0231443 | A1 | 12/2003 | Shea et al. | |

FOREIGN PATENT DOCUMENTS

| | | | |
|---|---|---|---|
| DE | 10 2008 013831 | A1 | 9/2009 |
| DE | 10 2011 121958 | A1 | 6/2013 |
| DE | 10 2013 105148 | A1 | 11/2014 |
| EP | 3 142 133 | A1 | 3/2017 |
| FR | 3 029 361 | A1 | 6/2016 |
| WO | WO 2014/048495 | A1 | 4/2014 |

OTHER PUBLICATIONS

German Patent Office, Office Action, Application No. 10 2017 106 117.7, dated Nov. 23, 2017, 5 pages.
China National Intellectual Property Administration, Notification of the First Office Action, Application No. 201880026587.X, dated Aug. 7, 2020, 8 pages (English translation).

* cited by examiner

ELECTRIC CLOSING ELEMENT

CROSS-REFERENCE TO RELATED APPLICATIONS

This application is the national phase entry of international patent application no. PCT/EP2018/051570 filed Jan. 23, 2018 and claims the benefit of German patent application No. 10 2017 106 117.7, filed Mar. 22, 2017, the disclosures of which are incorporated herein by reference in their entirety.

TECHNICAL FIELD

The object concerns an electric contactor (electrical normal open contact), in particular a high-voltage contactor, as well as a motor vehicle with such a contactor.

BACKGROUND ART

Electric contactors are well known. Particularly in automotive applications, electric contactors are often designed as relays. Relays are used to switch a first circuit (switch circuit) by means of a control pulse coming from a second circuit (control circuit), in particular to close it. However, the electrical isolation between the switch circuit and the control circuit is also dependent on the dielectric strength of the air. In addition, relays are complex to manufacture and therefore expensive. Finally, relays are subject to wear due to ageing. It is also possible that the switching mechanism of relays is jammed and switching is no longer possible.

In battery or fuel cell powered vehicles, switching is sometimes safety critical. Especially in high-voltage applications, where voltages of 1000V and more can occur, mechanically and electrically reliable switching is necessary. In particular for short-circuiting voltage carrying parts in the event of an accident, it is necessary that an electrical contactor has a low probability of failure. It is also necessary that the electrical contactor always ensures galvanic isolation between the switch circuit and the control circuit when open. In addition, the electrical contactor must remain capable of closing the circuit throughout the service life of a motor vehicle in order to guarantee the necessary safety at all times.

From DE 10 2011 121 958 A1 an electrically well insulating, mechanically fail-safe electric contactor is known. The contactor comprises a first connection lug and a second one, insulated from the first connection lug. By means of a closing element that can be driven by an actuator, an electrical connection can be established between the connection lugs, via which residual capacities can be safely dissipated in the event of an accident.

A disadvantage of the electrical contactor described here, however, is that due to construction-related tolerances and surface contamination, no reproducible and satisfactory contacts can be made between the closing element and the terminal lugs, so that the reduced transmission cross-sections result in insufficiently fast dissipation of residual capacitance, which also adversely operates only under strong heating.

Therefore, the subject matter was based on the object of providing an electrically well insulating, mechanically fail-safe electrical contactor that ensures fast and safe discharge of residual capacities.

SUMMARY OF THE INVENTION

The electrical contactor has two connection lugs which serve to connect the electrical contactor with electrical cables. The connection lugs are preferably made of a copper material or an aluminium material. The connection lugs can preferably also be nickel-plated and/or tinned, especially in an area where they are connected to energy conductors.

The connection lugs preferably lead into a housing and are arranged isolated from each other in the housing. A guide channel can be arranged inside the housing. This can at least be limited in areas by the connection lugs or their surfaces. In particular, the electrical contactor within the guide channel may have an electrical contact area in which the connection lugs are spaced apart and arranged opposite one another. The opposite ends of the terminal lugs can be shaped to form a receptacle for an electrical contact element.

In particular, the connection lugs can be arranged directly on the edge of the housing. Advantageously, the respective connection lugs can also be arranged at least partially within a recess in the housing.

In order to establish an electrical connection between the connection lugs, it is necessary for the contact element to be guided into the receptacle formed by the connection lugs. For this purpose, the first and second connecting lugs each have at least one recess in the contact region arranged inside the guide housing. There may also be more than one recess in each of the connecting lugs.

By inserting the contact element into the recesses of the terminal lugs, an electrical connection can be established between the terminal lugs.

To this end, the contact element must be electrically conductive at least in part, preferably at least along its surface, so that the contact element electrically connects the terminal lugs to one another as soon as it comes into electrical contact with the two terminal lugs.

The contact element is held in an open position in the guide housing. For this purpose, the contact element can be held in the open position by the guide housing in a form fit manner. In the open position, the contact element is arranged electrically isolated from the connection lugs.

The contact element is displaceable, preferably arranged so as to be transversally displaceable in the guide housing, whereby the contact element in the present arrangement is guided simultaneously in the direction of displacement in the respective recesses of the two connecting lugs when it is displaced. After displacement, the contact element is in a closed position. In the closed position, the electrical contactor is closed, in which an electrical short-circuit is created between the connection lugs by the contact element. The contact element is arranged with contact areas in the closed position in the receptacles of the connection lugs. This is achieved by displacing the contact element in the guide housing.

After an accident of a motor vehicle, this not only enables an electrical contact to be established as quickly as possible, but also promises a trajectory that is as reliable as possible when the contact element is moved.

An actuator is preferably provided for displacing the contact element, which actuator allows the contact element to be arranged electrically separated from at least one terminal lug in an open position of the electric closer, whereas the contact element is in electrical contact with both terminal lugs in a closed position of the electric closer and thus short-circuits them to one another.

For a space-saving arrangement of the electrical contactor, it is advantageous that the contact area of the connection lugs is located at a first end of the guide channel and the actuator at a second end of the guide channel opposite the first end.

The actuator is preferably electrically insulated from the connection lugs by the guide housing. For this purpose, the guide housing is preferably made of an electrical insulator, e.g. polyamide, e.g. PA 6.

Also the contact element can be formed at least in parts from an insulator. Only the part of the contact element which serves to electrically short-circuit the connection lugs and comes into mechanical contact with the connection lugs must be electrically conductive.

In order to nevertheless ensure a rapid discharge of residual capacities in the event of an accident, it is advantageous if the contact element is formed at least partially from an electrically conductive material with a high specific electrical conductivity, preferably at least partially from an aluminium material and/or a copper material. It is also proposed that the connection lugs are at least partly made of a conductive material, preferably at least partly of a copper material and/or an aluminium material. The conductive surfaces of the connection lug and contact element are preferably made of the same material, especially in the contact areas.

The contact element is formed in at least one contact region, in which it is held in the recesses in the closed position, as a flat part, in particular as a cuboid flat part. Because the contact areas are formed as flat parts, the contact element with its contact areas can slide into slot-shaped recesses to reach the closed position.

In order to produce high-quality contacting, in particular a particularly low-impedance connection between the terminal lugs, the shape of the contact element is also preferably at least partially substantially complementary, in particular a perfect fit with the recesses of the terminal lugs.

The contact element can be formed from a flat part, in particular from a cuboid flat part.

It has also been recognized that high-quality contacting is not only hindered by design tolerances, but also by the surface quality of the components to be contacted.

In the open position, the contact element rests at the housing, especially at the guide housing. In this position, a surface of the contact element, at least in the area of the contact areas, faces in the direction of the receptacles. This surface has a surface normal. The surface normal of the surface of the contact area facing the recesses in the open position is essentially parallel to the direction of displacement. This ensures that the contact element with the surface facing the recesses is moved in the direction of the recesses. The contact element contacts the recesses in the closed position preferably with other surfaces. In particular, the surface normal of these contact surfaces are perpendicular to the direction of displacement. The contact element preferably contacts the connection lugs with two opposing contact surfaces of the contact element, preferably running parallel to each other. The contact surfaces of the connection lugs, especially in the receptacles, are parallel to each other. The distance between the contact surfaces of the receptacles is preferably equal to the distance between the contact surfaces of the contact element, which may correspond to the height of the terminal element in the contact area.

The contact element preferably has at least four contact surfaces via which an electrical connection can be made between the terminal lugs, in particular both a first and second contact surface and a third and fourth contact surface being arranged substantially parallel to one another and substantially parallel to the direction of movement of the contact element.

The contact areas of the contact element can be spatially separated from each other. The contact element preferably has at least two contact areas which are spaced apart in a direction perpendicular to the displacement direction, preferably also perpendicular to a height direction of the contact element. In particular, the contact areas can be opposite each other in relation to a central axis of the contact element running parallel to the direction of displacement. Thus on both sides of a central axis of the contact element one contact area can be provided, each. The contact areas have the contact surfaces of the contact element, which in the closed position are in direct contact with the contact surfaces of the recesses. The distance between the contact areas can be essentially the same as the distance between the recesses. This ensures that the contact areas in the closed position are both located in the recesses.

When a contact is made between the contact element and the terminal lugs, the contact element can be guided in its movement through the recesses of the terminal lugs. Preferably, the contact element is guided, in particular, simultaneously by both connecting lugs, immediately after an electrical contact is made between the contact element and the connecting lugs.

It is also proposed that the contact element and the recesses of the connecting lugs are shaped and/or dimensioned relative to each other in such a way that a positive connection, in particular a press connection, is formed between the contact element and the connecting lugs during displacement. After displacement, in the closed position, a press fit, a transition fit or a clearance fit may be formed between the contact element and the connection lugs.

For a press fit, it is proposed in particular that the recesses are formed underdimensioned with respect to the contact element or that the contact element is formed overdimensioned with respect to the recesses.

As the recesses are formed to be undersized with respect to the contact element or the contact element is formed to be oversized with respect to the recesses, the surfaces of the components to be contacted can be at least partially freed from impurities or passivations by friction during the contacting, so that a high-quality contacting is ensured in which not only small proportions of the contact surface but preferably the largest part of the contact surface can be used for charge transfer.

In addition to a defined undersize, the contact element can also be tapered, especially wedge-shaped, on its side facing the recesses.

This not only improves contacting by displacing impurities and oxide layers, but a self-locking holding force can also fix the contact element in the recesses of the terminal lugs.

In order to safely prevent the electrical circuit from being reopened after the contactor has been closed, it is also proposed that the receptacle is formed in such a way that the contact element preferably snaps into the receptacle in a closed position of the contactor.

Therefore, snap-in lugs and/or snap-in recesses which are shaped and dimensioned relative to one another in such a way that a positive connection, in particular a snap-in connection between the contact element and the connection lugs, is formed during displacement can also be provided alternatively or cumulatively to slightly underdimensioned recesses or a slightly overdimensioned contact element in the recesses of the connection lugs and the contact element.

The actuator intended for driving the contact element according to the subject matter exerts such a great force on the contact element in the direction of the contact area that it can be displaced in the direction of the contact area. This allows the electric contactor to be moved into its closed position.

In order to achieve the necessary force transmission without losses, the contact element is at least positively, preferably non-positively, in particular materially connected to the displacement element.

The actuator can consist of an actuator element and a displacement element.

The actuator element can be formed as an electrical, hydraulic, pyrotechnical or mechanical actuator element, while the displacement element can, for example, be formed as a displacement carriage or as a piston.

In an embodiment in which the displacement element is formed as a piston, the piston is preferably arranged in the guide housing in such a way that a guide channel is sealed by it. The piston can be cylindrical. It is also possible that the piston is a cuboid guided in the guide housing. The sealing can be such that a space in the guide channel facing the actuator is sealed against a space in the guide channel facing the recess. This is particularly advantageous when the contact element is displaced into the receptacle using compressed air. Sealing can mean that the flow resistance for air in the guide channel through the piston is increased by more than 90%, preferably more than 95%.

The piston is preferably made of an insulating material, in particular polyamide, in particular PA 6. This ensures that the piston of the contact element provides reliable insulation between the conductive part of the contact element and the actuator. Preferably the piston faces the actuator and the contact element faces the recesses of the connecting lugs. The contact element can be moved within the guide housing between the actuator and the contact area of the connection lugs. Preferably the contact element is arranged in an open position of the contactor on the actuator, in particular on the displacement element. The contact element is preferably held in the guide housing in such a way that it can only be moved under the action of force. In particular, the contact element can be arranged in a press fit in the guide housing. The press fit can be such that a force of at least 10 N, preferably 20 N or at least 50 N is required to move the contact element transversally in the guide housing.

A pyrotechnic actuator can be realized, for example, by a thrust piston that can be activated by an electrical ignition pulse. For that a squib is arranged in a sleeve. Inside the sleeve there is a piston which can be displaced along the longitudinal axis of the sleeve and which is displaced in the sleeve by the explosion energy of the squib. The piston is pushed out of the sleeve by the displacement of the piston. The part of the piston pressed out of the sleeve can push the contact element in the direction of the receptacle.

In particular, it is preferred if at least one recess of the connecting lugs is arranged on opposite sides of the guide housing. The recesses can be hook-shaped and/or U-shaped and open in the direction of the contact element. The recesses can have a bottom which can serve as a stop for the contact element so that its maximum movement in the direction of displacement is defined.

The recesses make it possible to ensure a large contact surface of the contact element with the connection lugs despite the simple alignment and design of the electrical contactor.

In order to protect the contact element arranged in the guide channel preferably non-positively or materially on the displacement element from unintentional contacting with the connecting lugs, it is proposed that at least one insulation element is arranged between the contact element and the contact region of the connecting lugs for insulating the contact element, the insulation element preferably being formed in two pieces, in particular from two insulation caps.

The contact element has a surface facing in the direction of the connection lugs. The surface normal of this surface is preferably aligned with the direction of displacement. This surface is preferably covered by the insulation element. In particular, insulation elements can be arranged in the contact areas of the contact element.

In order to ensure sufficient insulation by the insulation element even at high voltages, it is proposed that the insulation material of the insulation element, in addition to a specific electrical conductivity of at least less than 10-5 S-cm-1, preferably less than 10-10 S-cm-1, is particularly 10-15 S-cm-1 has a dielectric strength of at least more than 5 kV/mm, preferably more than 20 kV/mm, particularly preferably more than 50 kV/mm. For this purpose, the insulation element may preferably be made of plastic or ceramic.

In accordance with an embodiment, it is proposed that two insulation caps are arranged between the contact element and the contact area of the terminal lugs for insulation of the contact element. These insulation caps are designed in such a way that at least parts of the insulation caps are separated, in particular torn off or sheared off, at the terminal lugs when the electrical contactor is closed. The insulation caps are arranged on the contact element, especially in the contact areas.

In contrast to at least parts of the insulation caps, which are sheared off at the connection lugs, the contact element is accelerated with the displacement element in the direction of the contact area of the connection lugs when the actuator unit is triggered, before the contact element is finally arranged in the recesses of the connection lugs and an electrical contact is established between the connection lugs.

For this purpose, the contact element is preferably arranged and, in particular with respect to the insulating element, designed in such a way that the contact element insulated in the open position with respect to the connecting lugs breaks through the insulating element after the actuator has been triggered. For this purpose, the contact element may preferably have a chisel-shaped taper on its surface facing away from the actuator, especially on the surface facing the connection lugs. The contact element can break through the insulation element at least in the area which, in the open position, borders directly on the recesses of the connecting lugs. Preferably, the insulation element is separated at least in the region of the interface between the insulation element and the surfaces of the contact lugs pointing in the direction of the insulation element.

It is also advantageous if the proposed insulation element not only has excellent insulation properties, but also preferably low breaking strength, in particular low shear strength. Therefore, according to an embodiment, it is proposed that the insulation element be made of a material with a shear strength according to DIN 18137-3 of at least less than 10 N/mm, preferably of at least less than 5 N/mm, particularly preferably of at least less than 1 N/mm.

It is also advantageous if the insulation element has a low breaking and shear strength as well as a low tear strength.

In addition to low breaking, shear and tear strength, it can also be particularly advantageous if the insulation material has predetermined breaking points which are preferably arranged in a potential contact area of the insulation element with the contact element and in a potential contact area with the terminal lugs. This makes it easier to break the insulation element through the contact element and shear it off from the contact lugs when the actuator is triggered.

According to an embodiment, it is proposed that the connection lugs arranged on the electrical contactor each have a connection part pointing out of the guide housing and a part guided in the guide housing, forming at least the receptacle. In particular, the connecting parts are shaped in such a way that electrical power lines can be connected to them in a loss-proof manner. This can be done using screw bolts or screw connections or crimp connections or the like. A soldered or welded connection can also be formed between the connecting parts and the power cables.

In the guide housing, the connection lugs in the area of the receptacle can be arranged electrically non-insulated. This enables the exposed areas of the connection lugs to be electrically short-circuited by means of the contact element.

In accordance with an embodiment, it is proposed that the connection lugs be elastically deformable in the guide housing at least in the area of the recesses. This ensures that the contact element can elastically and/or plastically push the connecting lugs apart in the area of the recesses in order to be moved into the closed position of the contactor. In this case, the connection lugs can spring back elastically and thus at least partially grip the contact element and hold it in the closed position.

In accordance with an embodiment, it is proposed that the guide housing should have a ventilation opening in the area of the receptacle, especially at one end remote from the actuator. When the contact element is displaced within the guide housing, the space between the receptacle and the contact element is reduced, whereas the space between the contact element and the actuator facing the actuator is increased. The reduction in space between the receptacle and the contact element leads to an increase in pressure. This would result in the contact element in the guide housing being pushed back and, if potentially, the force applied by the actuator would not be sufficient to push the contact element into the receptacle. A ventilation opening can therefore be provided to ensure ventilation. This is preferably provided centrally between the connection lugs in the area of the receptacle.

BRIEF DESCRIPTION OF THE DRAWING

In the following, the subject matter is explained in more detail using a drawing showing embodiments. In the drawing show.

DETAILED DESCRIPTION OF SPECIFIC EMBODIMENTS

Figure 1:
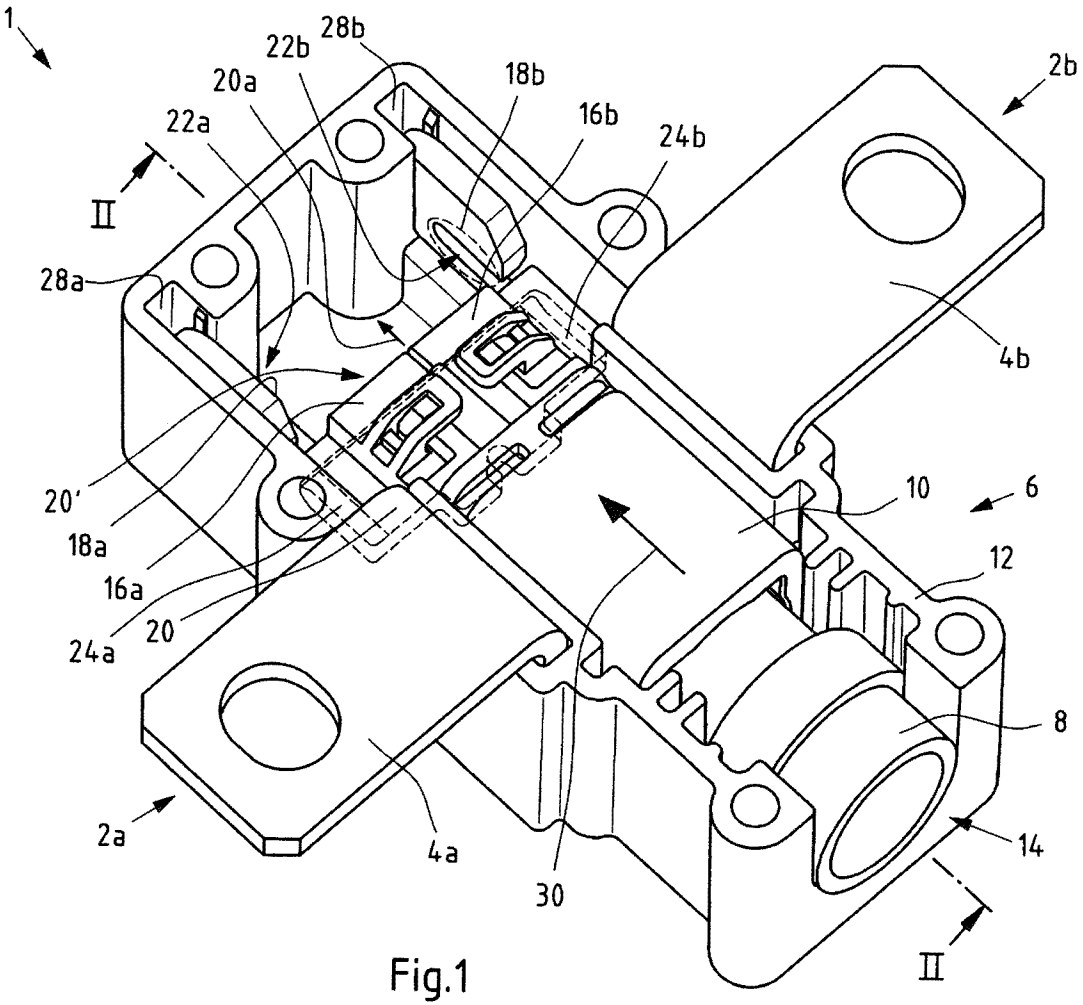
FIG. 1 a view of an electric contactor in an open position.

FIG. 1 shows a view of an electric closer 1 in an open position. An open guide housing 12 can be seen, which forms a guide channel 14 in its interior. An actuator 6 can also be seen, which consists of an actuator unit 8 and a displacement unit 10. The actuator unit 8 can be formed as an drive and convert electrical signals into mechanical motion. However, actuator unit 8 can also be designed as a pyrotechnic actuator unit and, for example, generate a mechanical displacement by igniting a squib by means of a pressure wave. The displacement unit 10 can, for example, be formed as a displacement slide or as a piston which is driven by the actuator unit 8 and performs a translational movement.

In the case of an embodiment in which a pneumatic impulse is triggered by the actuator unit 8, the guide channel 14 must be well sealed to the outside. In order to prevent an overpressure from occurring during a displacement of the displacement unit 10, which counteracts the movement in the displacement direction, it is proposed that a vent opening (not shown here) is arranged in the guide channel 14, or that the corresponding space is evacuated.

Furthermore it can be seen in FIG. 1 that a contact element 20 is arranged on the displacement unit 10, which in this view is covered by an insulation element 16. For the purpose of a more understandable representation, its arrangement is indicated by a dashed contour. The contact element 20 is firmly connected to the displacement unit 10 either by positive locking, frictional locking and/or material locking.

The contact element 20 is preferably made of a flat part and an electrically conductive material, preferably aluminium or copper.

Figure 4A:
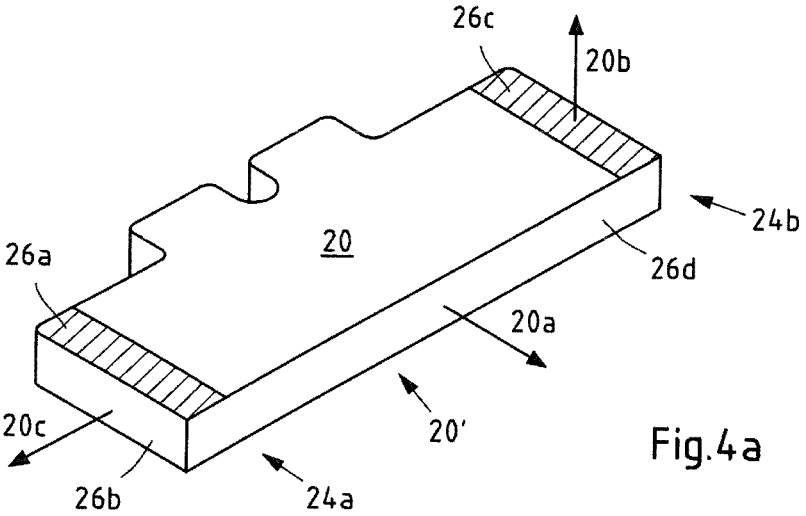
FIG. 4*a-c* A view of various design examples of a contact element.
Figure 4B:
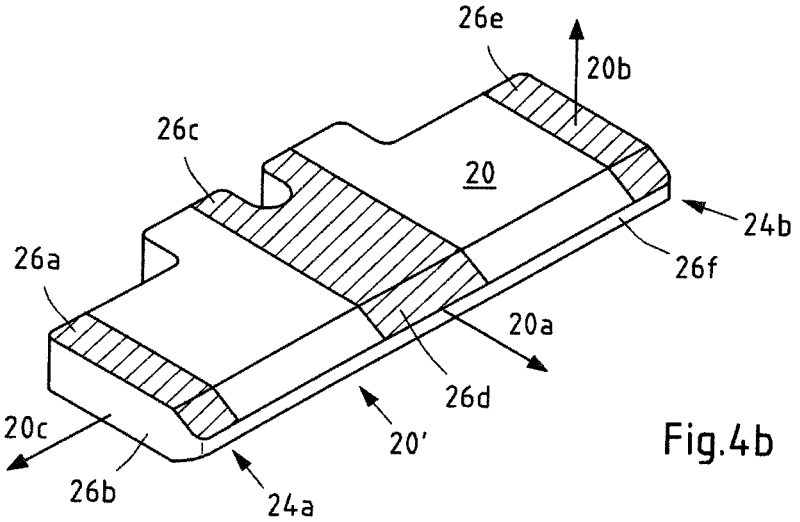
Figure 4C:
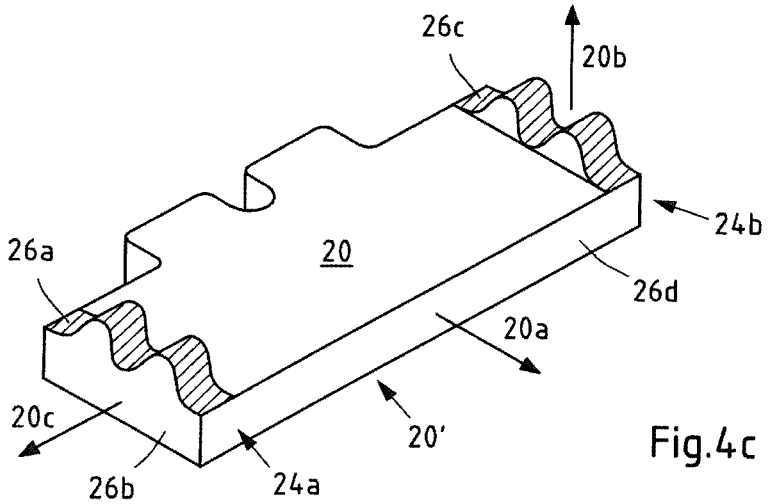

A more detailed view of the various embodiments of the contact element 20, including the designation of the respective contact areas, contact surfaces and surface normals, is shown in FIGS. 4*a-c*. These figures are referred to below if individual elements of contact element 20 are not shown in other figures due to the clarity.

In the open position, the contact element 20 rests on the housing 12. In this position, the contact element 20 has a surface 20' facing in the direction of the receptacles 22*a*, 22*b* of the connection lugs 4*a, b*. As can be seen from the arrangement according to FIG. 1, the surface normal 20*a* of this surface runs essentially parallel to the direction of displacement indicated by arrow 30 when the contact element 20 moves from the open position to the closed position.

It can also be seen that the contact element 20 has at least two spatially separated contact regions 24*a, b*, which are spaced apart from one another in a direction perpendicular to the displacement direction indicated by the arrow 30, preferably also perpendicular to a height direction of the contact element 20. The contact areas 24*a, b* can be designed as shown in FIG. 1, in particular in relation to a central axis of the contact element 20 running parallel to the direction of displacement. Thus a contact area 24*a* or 24*b* can be provided on both sides of a central axis of the contact element 20.

The contact surfaces 26*a*, 26*b*, 26*c*, 26*d* of the contact areas 24*a*, 24*b* of the contact element 20 intended for establishing an electrical contact with the terminal lugs 4*a*, 4*b* also have a surface normal 20*b* each. This respective surface normal runs essentially perpendicular to the surface normal 20*a* of the surface 20' of the contact element 20 facing in the direction of the 22*a*, 22*b* receptacles.

The contact element 20, which is essentially cuboid in shape according to FIG. 1, thus has at least four contact surfaces 26*a*, 26*b*, 26*c*, 26*d*, via which an electrical connection can be established between the connection lugs 4*a*, 4*b*. A first and a second contact surface 26*a* and 26*b* are arranged at the contact area 24*a*, whereas a third and a fourth contact surface 26*c* and 26*d* of the contact element 20 are arranged at the contact area 24*b*. The first and second contact surfaces 26*a*, 26*b*, as well as the third and fourth contact surfaces 26*c*, 26*d* are arranged spaced from each other according to the thickness or height of the contact element 20. Both the first and second contact surfaces 26*a*, 26*b* and the third and fourth contact surfaces 26*c*, 26*d* are also arranged substantially parallel to each other and substantially parallel to the direction of movement of the contact element 20.

Figure 2:
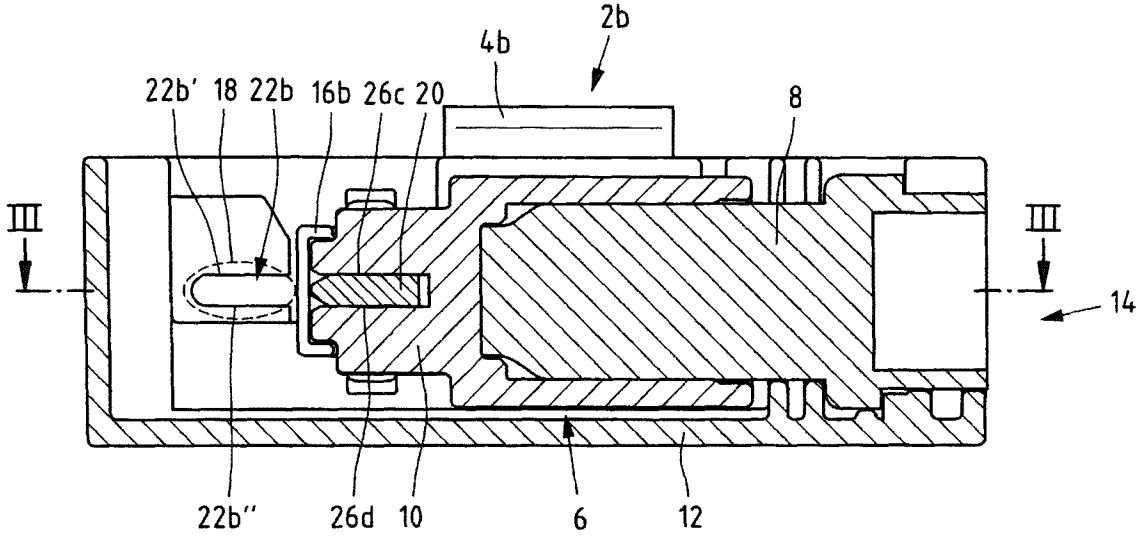
FIG. 2 a sectional view of an electric contactor according to FIG. 1.

The contact surfaces of the connection lugs 22*a*', 22*a*", 22*b*', 22*b*" arranged in the recesses 22*a* and 22*b* as shown in FIG. 2 also run substantially parallel to one another, in particular in the receptacles. The distance between the contact surfaces of the receptacles 22*a*', 22*a*", 22*b*', 22*b*'" preferably corresponds substantially to the distance between the first and second 26*a*, 26*b* or between the third and fourth 26*c*, 26*d* contact surfaces of the contact element 20, which may correspond to the height of the contact element 20 in the contact areas 24*a, b*. The distance between the contact surfaces of the receptacles 22*a*', 22*a*", 22*b*', 22*b*'" preferably corresponds substantially to the distance between the first and second 26*a*, 26*b* or between the third and fourth 26*c*, 26*d* contact surfaces of the contact element 20, which may correspond to the height of the contact element 20 in the contact areas 24*a, b*. The distance of the contact areas 24*a, b* to each other is also preferably substantially equal to the distance of the recesses 22*a*, 22*b* to each other. This ensures that the contact areas 24*a, b* in the closed position are both arranged in the recesses 22*a*, 22*b*.

The displacement element 10 for insulation is at least partly made of an insulator, preferably at least partly of a plastic.

It can also be seen that two connection parts 2*a*, 2*b* of two connection lugs 4*a*, 4*b* protrude from the housing 12. The connection lugs 4*a*, 4*b* also extend into the interior of the housing 12. Inside the housing 12, the connection lugs 4*a*, 4*b* run parallel to each other, parallel to the direction of displacement which runs along the axis II-II up to their contact area 18*a, b*, in which the connection lugs 4*a*, 4*b* each have at least one recess 22*a*, 22*b*. The connection lugs 4*a*, 4*b* can be arranged directly at the edge of the housing 12. The connection lugs 4*a*, 4*b* can also be arranged at least partially within a recess 28*a, b* of the housing 12.

The recesses 22*a*, 22*b* of the connection lugs themselves are preferably hook-shaped and/or U-shaped in the direction of the contact element 20 and have a base.

An insulation element 16 is arranged between the recesses 22*a*, 22*b* arranged in the contact region 18*a, b* of the connection lugs 4*a*, 4*b* and the contact element 20 in order to effectively prevent electrical contacting of the contact element 20 with the connection lugs 4*a*, 4*b* in the open state of the electrical contactor 1.

The insulation element 16 is preferably made of two parts, in particular two insulation caps 16*a*, 16*b*, which are placed on the displacement element 10. The insulation caps 16*a*, 16*b* preferably have not only a low electrical conductivity and a high dielectric strength required for insulation purposes, but advantageously also have a low tensile strength, breaking strength and shear strength.

The latter properties are desirable since, when a pulse is triggered by the actuator unit 8, it is preferably provided that the contact element 20 breaks through the insulation caps 16*a*, 16*b* during the acceleration of the contact element 20 in the direction of the contact region 18*a, b* at least in the region which, in the open position, directly adjoins the recesses 22*a*, 22*b* of the connecting lugs 4*a*, 4*b*. Preferably a separation of the insulation caps 16*a*, 16*b* is thus provided at least in the region of the interface between the insulation caps 16*a*, 16*b* and the surfaces of the contact flaps 4*a*, 4*b* pointing in the direction of the insulation caps 16*a*, 16*b*. In particular, the insulation caps 16*a*, 16*b* at the connection lugs 4*a*, 4*b* are at least partially separated, preferably torn off or sheared off.

In order to easily break the insulation caps 16*a*, 16*b*, the shape of the contact element 20 can also be adapted. For example, contact element 20 may have a chisel-shaped or wedge-shaped taper at its end remote from actuator unit 8.

In addition, it can be advantageous if the insulation caps 16*a*, 16*b* have, in addition to a low breaking, shearing and tearing strength, additionally (not shown here) predetermined breaking points which are preferably arranged in a potential contact region of the insulation caps 16*a*, 16*b* with the contact element 20 and in a potential contact region with the connecting lugs 4*a*, 4*b*, in particular the surfaces of the contact lugs 4*a*, 4*b* pointing in the direction of the insulation caps 16*a*, 16*b*. Thus the insulation caps 16*a*, 16*b* can advantageously be more easily broken through the contact element 20 and sheared off from the connection lugs 4*a*, 4*b* when the impulse of the actuator unit 8 is received.

FIG. 2 shows a sectional view of an electric closer 1 along line II-II as shown in FIG. 1. This view also shows the arrangement of the contact element 20, which is fixed to the displacement element 10 and hidden in the view shown in FIG. 1 by the insulation caps 16*a*, 16*b* used to insulate the contact element 20. The displacement direction of the contact element 20 runs from the displacement element 10 in the direction of the recesses 22*a*, 22*b*. After the triggering of a pulse of the actuator unit 8, it is intended that the contact element 20 is accelerated in the direction of the recesses 22*a, b*. Reduced to the contact tab 4*b* shown in the sectional view, the opening of at least part of the insulation cap 16*b* is provided after acceleration of the contact element 20, so that electrical contact can be established between the contact surfaces 26*c, d* of the contact element 20 and the contact surfaces 22*b*' and 22*b*" of the connection lug. From the moment an electrical contact is made between contact element 20 and connection lug 4*b*, contact element 20 is preferably guided in the direction of movement in recess 18*b*. The movement of the contact element 20 initiated by the actuator unit 8 is continuously slowed down by the continuously increasing contact surface between the contact surfaces 26*c, d* of the contact element 20 and the contact surfaces 22', 22" of the terminal lug 4*b* and the associated greater friction.

A corresponding movement and contacting is also provided between the contact surfaces 26*a, b* of the contact element 20 and the contact surfaces 22*a*' and 22*a*" of the connection lug, which are not shown in this sectional view, after a pulse of the actuator unit 8 has been triggered.

Figure 3:
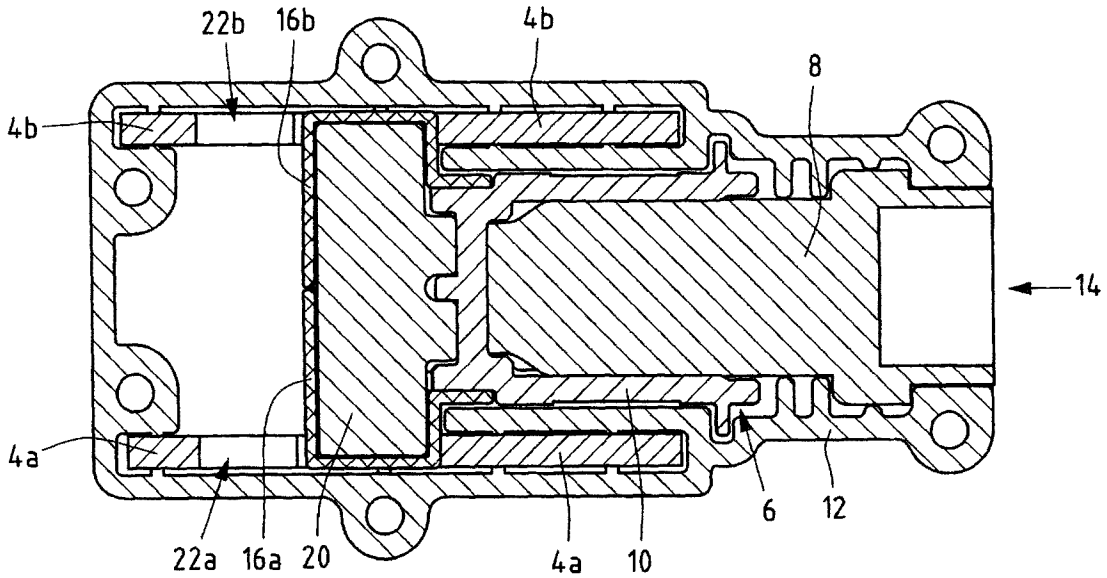
FIG. 3 another sectional view of an electric contactor according to FIG. 1.

FIG. 3 shows a sectional view of an electric closer 1 after a section along line III-III according to FIG. 2. This view also shows the arrangement of the contact element 20, which in the open state of the electric closer 1 is still insulated by the insulation caps 16*a*, 16*b*, separated from the connection lugs 16*a*, 16*b*.

FIG. 4*a-c* shows a selection of different embodiments of the contact element 20 that is by no means to be understood as conclusive.

FIG. 4*a* shows a substantially cuboid contact element 20, which comprises the separately arranged contact areas 24*a* and 24*b*. The contact areas 24*a, b* are arranged at the outer edge areas of the contact element 20 and each have the contact surfaces 26*a* and 26*b* or 26*c* and 26*d* arranged on opposite sides of the contact element 20.

Furthermore, the surface 20' is visible, which points in the direction of the receptacles 22*a* and 22*b* when the contact element 20 is installed. The surface normal 20*a* of this surface is also shown, which runs essentially parallel to the direction of displacement when the contact element 20 moves from the open position to the closed position.

In addition, the two surfaces 20*b* and 20*c*, each arranged perpendicular to the surface 20*a*, together with their respective surface normal values, can be recognized. The surface normal 20*b* is perpendicular to the wide surface of the contact element 20. The surface normal 20*c* is perpendicular to the outward facing surface of the contact element 20.

In addition to an embodiment formed as a cuboid flat part in accordance with FIG. 4*a*, FIG. 4*b* shows an embodiment of a contact element 20 in which the end of the contact element 20 facing away from the actuator is tapered, in particular is formed tapered in the form of a chisel or bolt. Such an embodiment not only has the advantage that the insulation caps 4*a*, 4*b* can be cut more easily when the actuator unit 8 is triggered, but also allows the tapered part of the contact element 20 to be inserted into the recesses 22*a*, 22*b* in a simple manner, even with given manufacturing tolerances, the formation of a press connection between the contact element 20 and the recesses 22*a*, 22*b* of the connecting lugs 16*a*, 16*b*. By means of a press connection it is possible to at least partially remove impurities or passivations from the surfaces of the components to be contacted during the contacting by friction, thus guaranteeing high-quality contacting. In addition to the contact areas 24*a* and 24*b*, the embodiment according to FIG. 4*b* also has a third contact area arranged between these two areas, whereby in this case not only four contact surfaces but also a total of six contact surfaces with the contact surfaces 26*a-f* are arranged.

FIG. 4*c* finally shows an embodiment in which the contact element has 20 latching lugs and latching recesses in the contact areas 24*a* and 24*b*, which serve in particular to prevent the electric closer 1 from opening after the closer 1 has closed. This is achieved in particular by the fact that the contact element 20 and the recesses 22*a*, 22*b* of the connecting lugs 4*a*, 4*b* are formed in such a way that the contact element 20, in a closed position of the closer 1, preferably engages in the receptacle in a positive-locking manner. It goes without saying that corresponding latching lugs and latching recesses can be arranged not only on the contact surfaces 26*a* and 26*c*, but also alternatively or cumulatively on the contact surfaces 26*b* and 26*d*.

Figure 5:
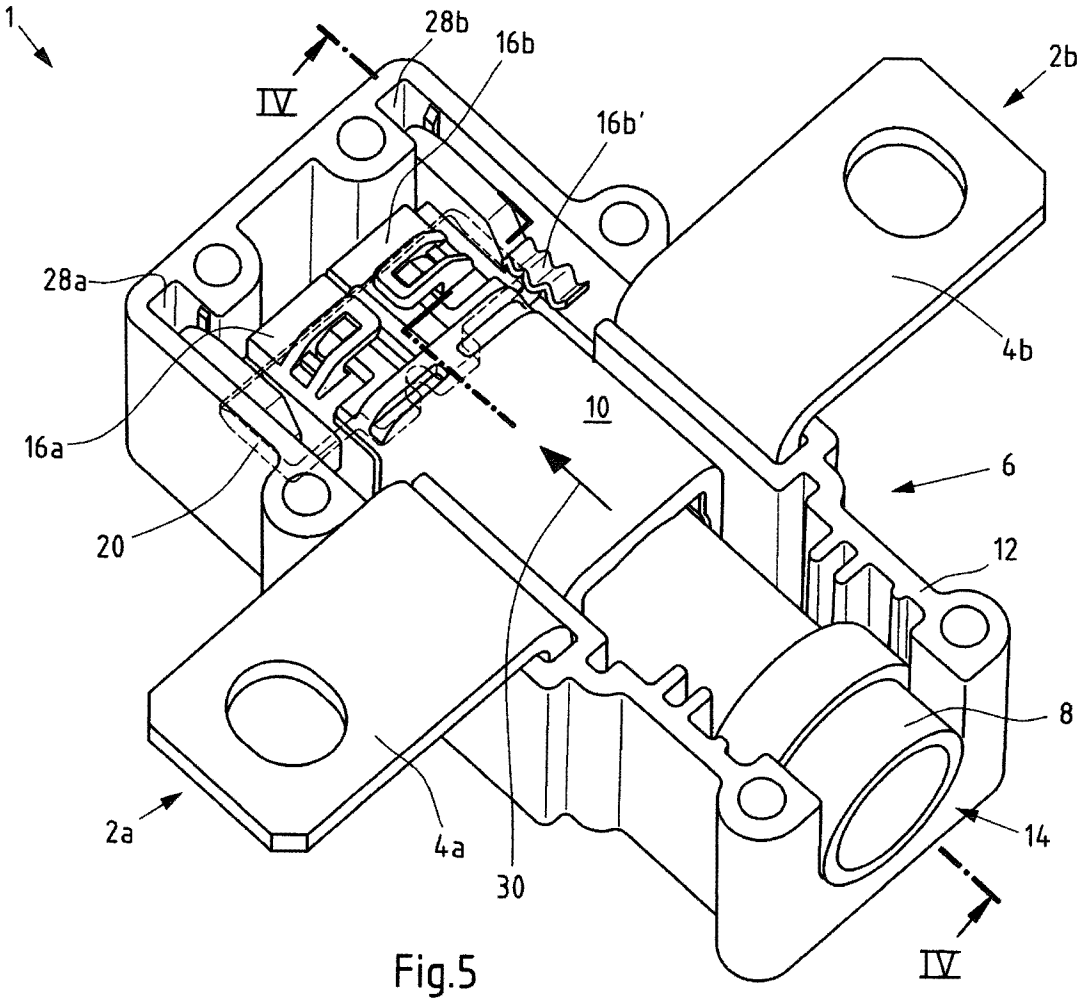
FIG. 5 a view of an electric contactor in a closed position.

FIG. 5 finally shows a spatial view of an electric closer 1 in a closed position.

In the closed position the contact element 20, in particular the contact areas 24*a, b* of the contact element 20, are arranged in the recesses 22*a*, 22*b* of the connection lugs.

An electrical contact is established between the two terminal lugs 4*a*, 4*b* via the direct contact of the contact surfaces of the contact element 26*a, b, c, d* with the contact surfaces of the recesses 22*a*', 22*a*", 22*b*', 22*b*", so that electrical charge can be dissipated safely and reliably via the two interconnected terminal lugs 4*a*, 4*b*.

In this position, the contact element 20 is arranged in the mounting of the connection lugs 4*a*, 4*b* and thus closes them short. By short-circuiting the connection lugs 4*a*, 4*b*, it is possible to allow the discharge of residual capacities, as may be necessary in the event of an accident with a motor vehicle. It can be seen that the insulation caps 16*a*, 16*b* have been partially separated at the connection lugs 4*a*, 4*b*, whereby only the sheared off remainders of the insulation caps 16*a*' and 16*b*' remain at the contact surfaces between the connection lugs 4*a*, 4*b* and the insulation caps 16*a*, 16*b*. The remaining part of the insulation caps 16*a*, 16*b* is finally arranged between the contact element 20 and the wall of the housing 12.

The displacement is triggered by the actuator unit 8. After initiation of an electrical impulse, for example, another electrical, mechanical, hydraulic or pneumatic impulse is triggered in the actuator unit 8, which accelerates the displacement unit 10 together with the contact element 20 arranged in the direction of the contact area 18*a, b* of the connection lugs 4*a*, 4*b*. The displacement unit 10 can be formed as a displacement carriage or as a piston which pushes the contact element 20 in the direction of displacement into the receptacle.

During this movement, the contact element 20 first breaks through the insulation caps 16*a*, 16*b* arranged between the actuator unit 6 and the contact area 18*a, b*, before the contact element 20 is finally inserted into the recesses 22*a*, 22*b* of the connection straps 4*a*, 4*b*.

Figure 6:
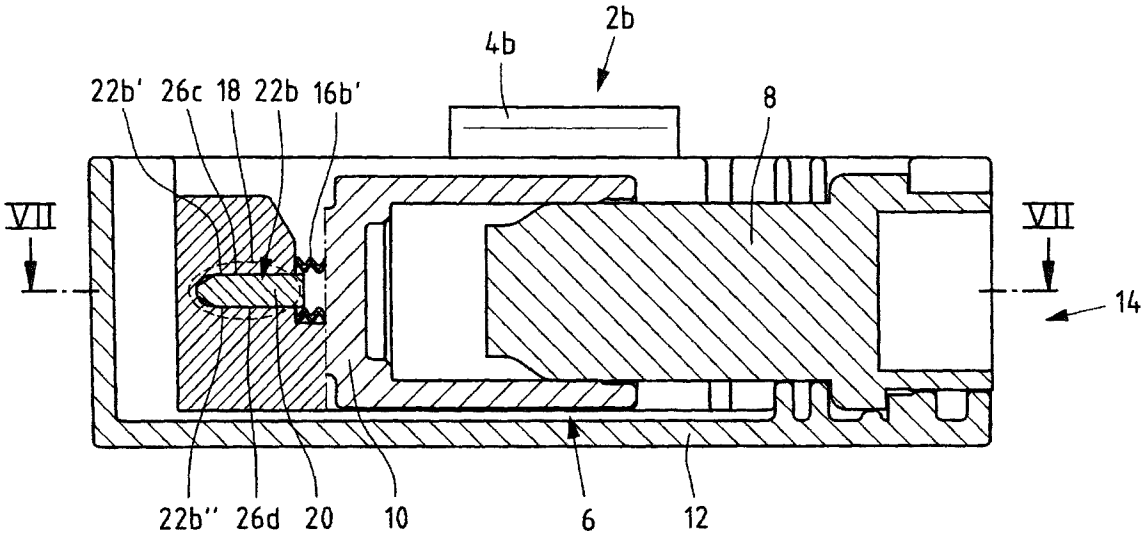
FIG. 6 a sectional view of an electric closer according to FIG. 5.

FIG. 6 shows a sectional view of an electrical contactor 1 along the line IV-IV as shown in FIG. 5. In this view, the electrical contacting produced between the contact surfaces 26*c, d* of the contact element 20 and the contact surfaces 22*b*' and 22*b*" of the terminal lug can be seen due to the offset of the view. In addition, in the contact area 18*a, b* of the connection lug 4*b*, in addition to the contact element 20 now arranged within the recess of the connection lug 4*b*, the part of the insulation cap 16*b*' sheared off at the connection lug 4*b* can also be seen.

Figure 7:
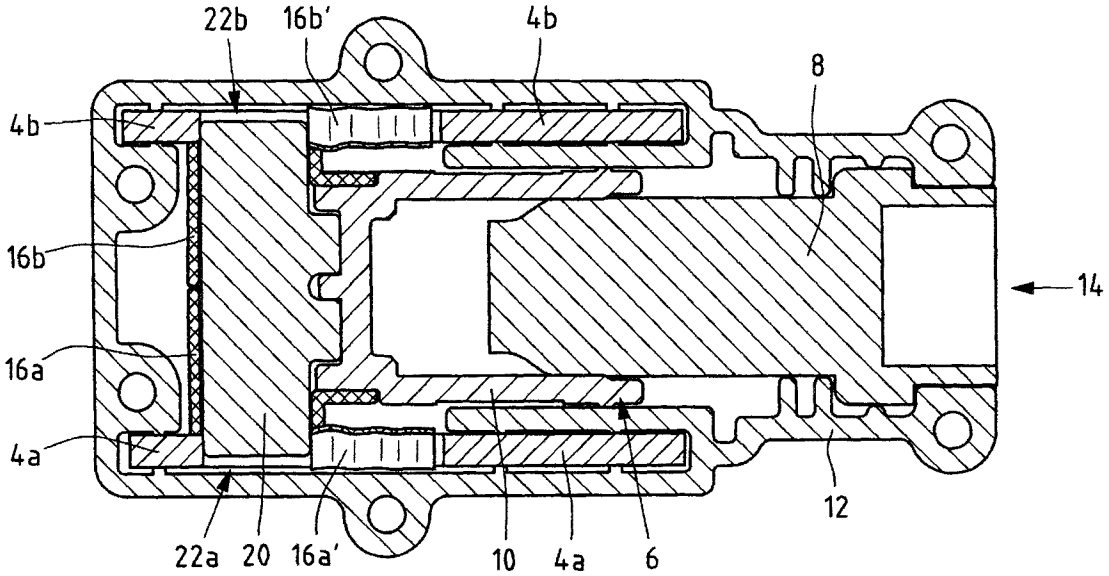
FIG. 7 another sectional view of an electric contactor according to FIG. 5.

FIG. 7 shows a sectional view of an electric closer 1 along line VII-VII as shown in FIG. 6. In this view, in addition to the contact element 20 arranged within the recess of the connection lugs 4*a*, 4*b*, the parts of the insulation cap 16*a*', 16*b*' sheared off at the connection lugs 4*a*, 4*b* are also visible.

With the help of the electric closer 1 it is possible to establish a fast and high quality electrical connection between the connection lugs in order to guarantee a fast and safe removal of residual capacities.

The proposed electrical make contact 1 is not only electrically well insulated and mechanically fail-safe, but also allows a reproducible and satisfactory contact between the contact element and the terminal lugs.

What is claimed is:

1. Electric contactor comprising:

a first connection lug;

a second connection lug electrically insulated from the first connection lug, the first and second connection lugs each having at least one recess in a contact region arranged within a guide housing;

an actuator for driving a contact element, the contact element being arranged in a guide housing between the actuator and the contact region of the connecting lugs and being displaceable by the actuator from an open position, in which the connecting lugs are insulated from one another, into a closed position, in which the connecting lugs are electrically connected to one another via the contact element, the contact element being received in the recesses of the connecting lugs in the closed position, wherein during the displacement the contact element is guided in the direction of displacement simultaneously in the respective recesses of the two connecting lugs; and wherein the contact element is formed in at least one contact region, in which it is held in the recesses in the closed position, as a flat part, wherein the shape of the contact region is essentially complementary to the recesses of the connecting lugs.

2. Electric contactor according to claim 1, wherein the contact element is formed at least partially from an electrically conductive material, preferably at least partially from an aluminium material and/or a copper material and/or in that the connecting lugs are formed at least partially from a conductive material, preferably at least partially from a copper material and/or an aluminium material.

3. Electric contactor according to claim 1, wherein the surface normal of the surface of the contact region facing the recesses in the open position is substantially parallel to the displacement direction.

4. Electric contactor according to claim 1, wherein the contact regions are spatially separated from one another, in particular that the contact regions lie opposite one another with respect to a central axis of the contact element extending parallel to the displacement direction, in particular that the distance between the contact regions is substantially equal to the distance between the recesses.

5. Electric contactor according to claim 1, wherein the contact element is shaped and/or dimensioned relative to the recesses of the connecting lugs in such a way that, during displacement, a positive connection, in particular a press fit, a transition fit or a clearance fit is formed between the contact element and the connecting lugs.

6. Electric contactor according to claim 1, wherein the connecting lugs each have a connecting part facing outward of the guide housing and a part arranged in the guide housing and guiding the contact element during displacement, and/or in that the receptacles are arranged on opposite sides of the guide housing.

7. Electric contactor according to claim 1, wherein the recesses of the connecting lugs and the contact element have latching lugs and/or latching recesses which are shaped and dimensioned relative to one another in such a way that, during displacement, a positive connection, in particular a latching connection, is formed between the contact element and the connecting lugs.

8. Electric contactor according to claim 1, wherein the guide housing has a guide channel in which the contact element is displaceably arranged.

9. Electric contactor according to claim 1, wherein the contact region of the connection lugs is disposed at a first end of the guide channel and the actuator is disposed at a second end of the guide channel opposite the first end.

10. Electric contactor according to claim 1, wherein at least one insulating element is arranged for insulating the contact element between the contact element and the contact region of the terminal lugs, the insulating element preferably being formed in two pieces, in particular from two insulating caps, in particular in that one of the insulating elements in each case covers at least the surface of the contact element facing the terminal lugs in the open position.

11. Electric contactor according to claim 1, wherein the insulating element is formed from an insulating material, wherein the insulating material has a specific electrical conductivity of at least less than 10-5 S-cm-1, preferably less than 10-10 S-cm-1, particularly preferably 10-15 S-cm-1, in particular that the insulating material has a dielectric strength of at least more than 5 kV/mm, particularly preferably more than 20 kV/mm, especially preferably more than 50 kV/mm.

12. A motor vehicle with a power line and an electric contactor connected to the power line in accordance with claim 1.

13. Electric contactor according to claim 1, wherein the actuator comprises an actuator element and a displacement element, in particular that the actuator element is an electric, a hydraulic, a pyrotechnic or a mechanical actuator element.

14. Electric contactor according to claim 13, wherein the displacement element is formed as a sliding carriage or as a bolt, the contact element being connected to the displacement element in a positive-locking, preferably force-locking, in particular material-locking manner.

* * * * *